United States Patent [19]

Shy

[11] 4,297,953

[45] Nov. 3, 1981

[54] EASILY FOLDAWAY STAND

[76] Inventor: Min C. Shy, 20, Alley 18, La. 109, Hoping St., Yong Ho Twon, Taipei Hsien, Taiwan

[21] Appl. No.: 112,263

[22] Filed: Jan. 15, 1980

Related U.S. Application Data

[63] Continuation of Ser. No. 945,998, Sep. 26, 1978.

[51] Int. Cl.[3] ..... A47B 3/08

[52] U.S. Cl. ..... 108/131; 108/132; 248/188.6

[58] Field of Search ..... 108/132, 131, 129; 248/188.6

[56] References Cited

U.S. PATENT DOCUMENTS

| | | | |
|---|---|---|---|
| 941,524 | 11/1909 | Krumsee | 108/131 |
| 2,882,109 | 4/1959 | Eves et al. | 108/132 |
| 3,057,670 | 10/1962 | Russo | 108/132 X |
| 3,669,031 | 6/1972 | Cole | 108/132 |
| 3,695,567 | 10/1972 | Weagle | 108/132 |
| 4,063,703 | 12/1977 | Shy | 108/132 |

FOREIGN PATENT DOCUMENTS

| | | | |
|---|---|---|---|
| 250194 | 3/1964 | Australia | 108/132 |
| 236593 | 10/1964 | Austria | 108/132 |

*Primary Examiner*—Francis K. Zugel
*Attorney, Agent, or Firm*—Karl W. Flocks

[57] ABSTRACT

An easily foldaway stand comprises of two pairs of legs which can be moved upward freely and plugged into the respective counter parts prefixed on the two sides of the base of an oven or a table. Furthermore, a bar is fixed horizontally on tips of each pair of legs. When the legs of the stand stretch out uprightly, the said two bars will parallel match the respective prefixed on the two sides of the base of an oven or a table. Hence the prefixed bars and prefixed shelves can be fastened together by applying screws or fasten latch etc. to achieve the stability of the legs to stretch out uprightly.

5 Claims, 11 Drawing Figures

EASILY FOLDAWAY STAND

This is a division of application Ser. No. 945,998, filed Sept. 26, 1978.

BACKGROUND OF THE INVENTION

The present invention relates to a easily foldaway stand particularly refers to a simple but newly constructed stand which can be folded or uprightly stretched out easily and conveniently.

During the past, there are so many foldaway stand have been marketed to public. However, these said stands have always been found and commented as not practical due to its complexity in construction, high manufacturing cost and the inconvenience in folding operation.

The present invention is to improve the shortcomings of above mentioned general foldaway stands and to provide a simple but newly constructed stand which can also be folded or stretched uprightly out easily and conveniently.

SUMMARY OF THE INVENTION

The present invention consists of two pairs of legs which can be moved upward freely and plugged into the respective counter parts prefixed on the two sides of the base of an oven or a table. There is a fixed bar connected horizontally on tips of each pair of legs. When the legs of the stand stretch out uprightly, the said two bars will parallel match the respective shelves prefixed on the two sides of the base of an oven or a table. Hence, the prefixed bars and the prefixed shelves can be fastened together by applying screw or fasten latch etc. to achieve the stability of the legs to stretch out uprightly.

The invention is to provide a stand which can be folded easily. The most outstanding characteristic of this stand is the super stability resulted from the fact that legs of stand have already been firmly attached to oven or table so that the legs with oven/table considered as a whole when the legs of stand stretch uprightly out.

DETAILED DESCRIPTION

Figure 1:
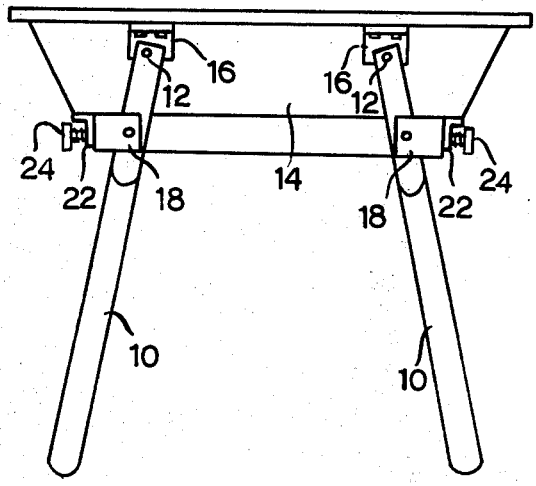
FIG. 1 is a elevation of the present invention of easily foldaway stand when legs were stretched out uprightly.
Figure 2:
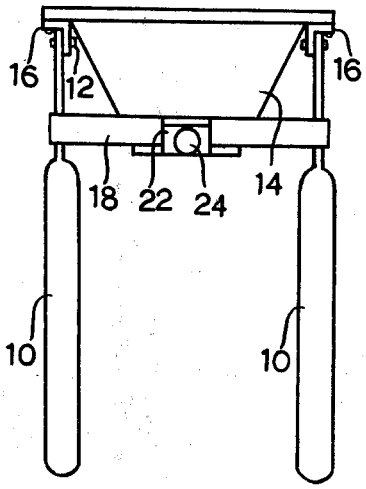
FIG. 2 is a side view drawing of the FIG. 1 when legs were strectched out uprightly.
Figure 3:
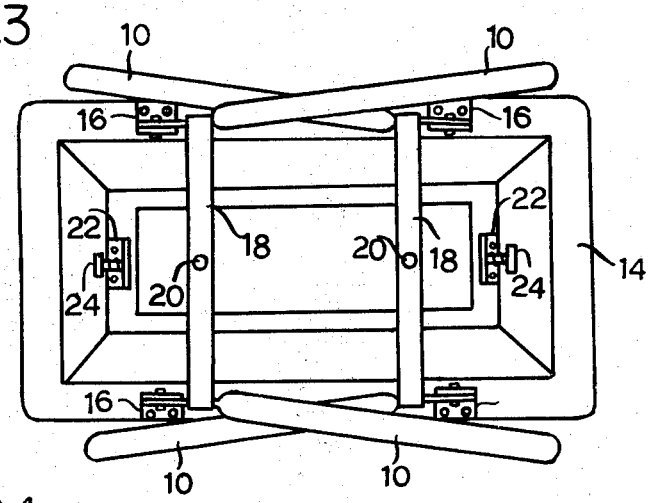
FIG. 3 is a bottom plan view of the structure of FIGS. 1 and 2 with the legs folded in storage condition.

As shown in FIG. 1 to FIG. 3, the easily foldaway stand of the present invention consists of two pairs of legs 10 which can be functioned by means of spindle 12 upward freely and plugged into the respective counter parts prefixed on the "L" type fixtures 16 on the two sides of the base of an oven 14. Besides, there is one bar 18 horizontally laid between each pair of legs 10. A hole 20 for fixing screw is located on center of the fixed bar 18. When the legs are upward stretched out, as illustrated in FIG. 1 and FIG. 3, the said two fixed bars 18 rightly and closely match the respective two "L" type shelves 22 fixed on two sides of the oven 14. Meantime, the screw hole 20 on center of the fixed bars 18 will match top end of pre-reserved screw 24 located on the "L" type shelves 22. Hence, the pre-reserved screw 24 can be driven into the screw hole 20 in order to fasten the fixed bar 18 and the shelves 22 together. Thus, the oven will then be stabilized and will not be easily vibrated as being thrusted.

To fold the stand, one simply has to turn the knob 26 of the pre-reserved screw 24 to an anti-direction enabling the two pre-reserved screws 24 to come off the screw hole 20 respectively. By doing so, it will further enable the two fixed bars 18 to come off from the attaching position with shelves 22 and then fold down the two pairs of legs flatly laid on the base 14 of an oven as shown in FIG. 2.

Figure 9:
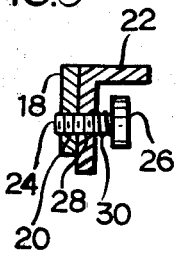
FIG. 9 is a section drawing of the conjuncture of the prefixed bars and the prefixed shalves fastened by applying a screw.

Referring to FIG. 9, the top end of the pre-reserved screw 24 is a little bit larger than the screw hole on shelves 22 to ensure the pre-reserved screw 24 being unable to come off from the hole 28 which pre-reserved screw comes through. There is a compressed spring 30 on the top of pre-reserved screw 24 to avoid the pre-reserved screw 24 to move further caused by carelessness or affacted by outside force after the pre-reserved screw 24 withdraw from the screw hole 20 and also to avoid the refoldness of pre-fixed bar 18 when the legs of stand will be stretched upward out.

Figure 4:
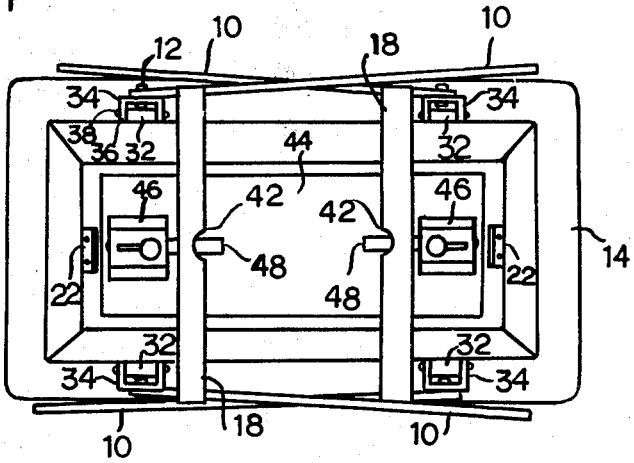
FIG. 4 is a bottom plan view similar to FIG. 3 of an alternative or supplementary form of the invention in folded storage condition.

In FIG. 4, it is a supplementary of this invention of easily foldaway stand, wherein, there are at the two ends on the base of the oven 14 two pairs of pre-fixed base 32 to be fastened with two pairs of "U" type fixtures 34 by means of the screw 38 coming through its two sides connecting on the pre-fixed base respectively. Hence, two pairs of legs 10 can be functioned by means of spindle 12 upward freely and plugged respectively into the front parts prefixed on the "U" type fixtures 34. Besides, there is one fixed bar 18 each laid horizontally between each pair of legs 10 and there is a half-round opening 42 located on center of fixed bar 18. When legs are upward stretched out, the said two fixed bars 18 rightly and closely match the two "L" type shelves 22 fixed respectively on two sides of the oven 14, and the bottom of the oven 44. Furthermore, the fixed bar 18 can be fixed between the "L" type shelves 22 and the bottom of the oven 44 to ensure the stability of the legs by means of the lever 48 of the latch 46 to be catched into the screw hole 28 of the shelves 22 so as to making the lever pressing the opening 42 of the shelves 22.

The above said half-round opening 42 on fixed bar 18 can be replaced by full-round opening. But, the lever 48 can not be easily matched the full-round opening and thus it will be easily formed a minor mistake, which will certainly affact the operation. Because of this reason, it is still advisable to press the lever to be matched half-round opening 42.

Figure 5:
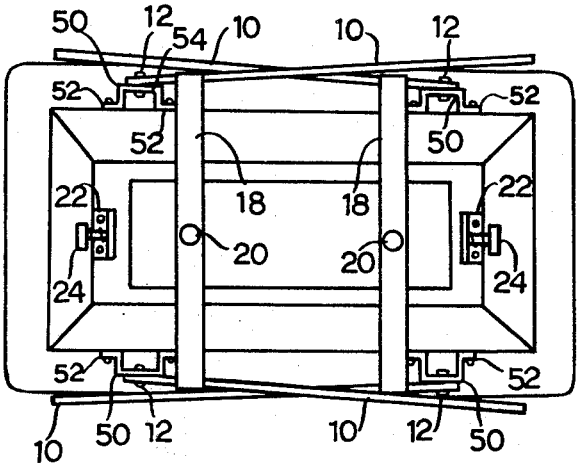
FIG. 5 is a bottom view drawing after folded of the second supplementary easily foldaway stand of the invention.

Referring to FIG. 5 which is the second supplementary drawing of this invention. Its construction, installment as well as operation are similar to those as detailed in FIG. 1 with the only exception of the two sides 52 of the fixture 50 are "L" type to ensure the fixtures 50 fixed on the bottom of the oven and also ensure two pairs of legs 10 by means of spindle 12 to be able to stretch upward out freely and plugged into the respective from part 54 of the fixtures 50.

Figure 6:
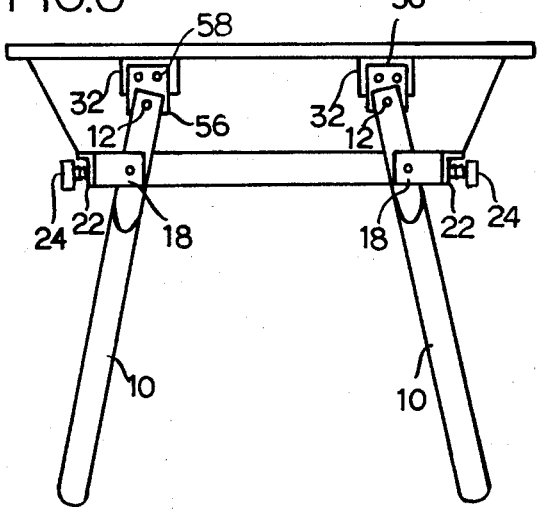
FIG. 6 is a elevation drawing after legs were stretched out uprightly of the third supplementary easily foldaway stand of the invention.
Figure 7:
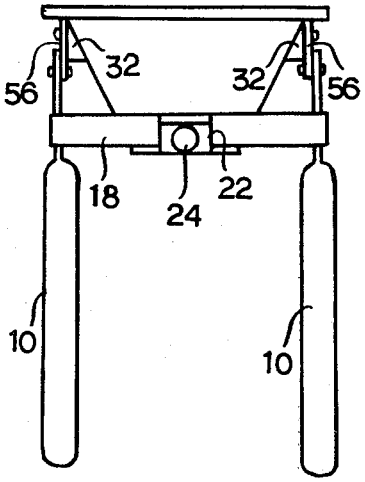
FIG. 7 is a side view drawing of the FIG. 6.

Referring to FIG. 6 and FIG. 7 which are the third supplementary drawings of this invention. Its constructions, installments; and operations are mostly similar to those as covered by first and second supplements of this invention. The two pairs of pre-fixed base 32 on the two sides of the bottom of oven 14 enables the flat type fixture 56 to be fixed on prefixed base 32 by means of screw 58 and also enables two pairs of legs 10 by means of spindle 12 to stretch upward out freely and to plug into the respective ends of the fixtures 56.

Figure 8:
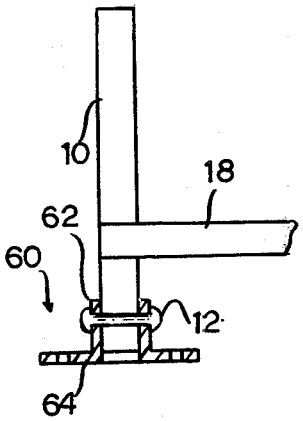
FIG. 8 is a elevation of part of the easily foldaway stand of a furthermore embodiment the invention.

In FIG. 8, the fixture 60 is formed by two parallel supporting posts 62 extended out from the center of the base 64. Hence, legs 10 by means of spindle 12 can stretch upward out freely and can be plugged respectively into the supporting posts 62.

Figure 10:
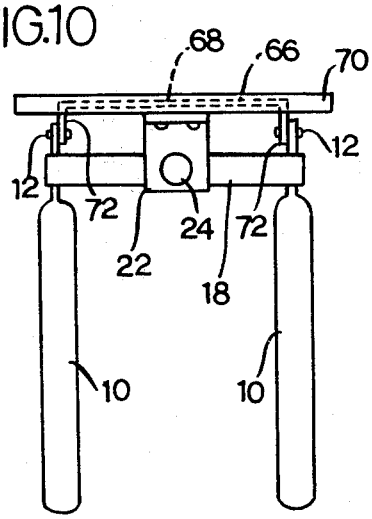
FIG. 10 is a elevation drawing of the invention after installed to a table with legs stretched out uprightly.

Above are the examples of the present invention of easily foldaway stand to be installed on oven. Furthermore the present invention can be installed to table as illustrated per FIG. 10. The bottom part of the "U" type fixture 66 is fixed and fastened between the plywood of the table 70 and plug the legs 10 into the respective two sides 72 of the "U" type fixtures 66 by means of the spindle 12 which can be stretched upward out freely. As to the operation of this example, please refer to previous ones which are similar to this.

Figure 11:
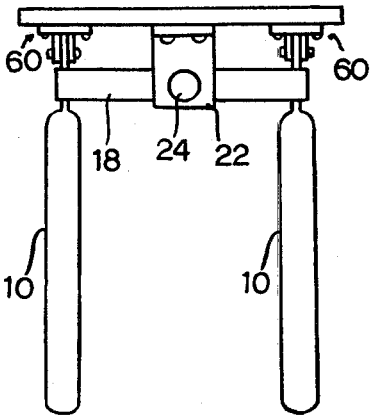
FIG. 11 is a elevation of the invention after installed to a table.

FIG. 11 is a supplementary drawing of the present invention when applied to a table. The fixture 60, similar as the example illustrated per FIG. 8, is formed by two parallel supporting posts 62 extended out from the center of the base 64. Hence, legs 10 by means of spindle 12, which can be stretched upward out freely, can be plugged into the respective supporting post 62.

I claim:

1. An oven or table having relatively deep side walls extending down a substantial distance from an upper edge to a lower surface in combination with an easily foldaway stand comprising at least one pair of legs, means pivotally connecting each of said legs at its upper end to opposite sides of said oven or table adjacent said upper edge whereby said legs may be optionally extended to supporting position or folded to storage position, a horizontally extending bar disposed intermediate opposite ends of each of said legs at a substantial distance down from said upper ends of said legs and secured thereto, said bar being in substantial abutment with said lower surface when said legs are extended, latch means provided at one end of said oven or table for cooperation with said bar to secure said bar to said surface and said pair of legs in upright condition and to impart a significant measure of stability to said legs.

2. The combination according to claim 1 wherein said pivotally connecting means is in the form of an "L" type bracket, one end of the "L" type bracket is fixed on the bottom of said upper edge, while the other end is connected with a lever portion of the leg by means of a spindle.

3. The combination according to claim 1 wherein said pivotally connecting means is in the form of a "U" type bracket, the two sides of the "U" type bracket are fastened by means of screw to a prefixed member adjacent the top edge of the side wall of said oven or table while the front part of the bracket is pivotally connected by means of a spindle with the lever portion of the leg.

4. The combination according to claim 1 wherein said pivotally connecting means is in the form of a flat type bracket, one end of the flat type fixture is fastened by means of screw to a prefixed base adjacent the top edge of the side wall of the oven or the table, while the other end is connected by means of a spindle into a lever portion of the leg.

5. The combination according to claim 1 wherein said pivoting connecting means is formed by two parallel supporting posts extending down from the under side of the table to enable the legs by means of a spindle to be connected with the supporting posts to such an extent that the legs can be uprightly stretched out freely.

* * * * *